US007388567B2

(12) United States Patent
Lin et al.

(10) Patent No.: US 7,388,567 B2
(45) Date of Patent: Jun. 17, 2008

(54) LIQUID CRYSTAL DISPLAY

(75) Inventors: Hsiao-Yi Lin, Hsinchu (TW); Hsiu-Chi Huang, Hsinchu (TW)

(73) Assignee: TPO Displays Corp., Chu-Nan (TW)

( * ) Notice: Subject to any disclaimer, the term of this patent is extended or adjusted under 35 U.S.C. 154(b) by 610 days.

(21) Appl. No.: 10/901,004

(22) Filed: Jul. 27, 2004

(65) Prior Publication Data

US 2005/0024314 A1 Feb. 3, 2005

(30) Foreign Application Priority Data

Jul. 28, 2003 (TW) ..... 92120482 A

(51) Int. Cl.
*G09G 3/36* (2006.01)

(52) U.S. Cl. ..... 345/92; 345/87

(58) Field of Classification Search ..... 345/76–77, 345/87–88, 90, 92, 94–100, 204–205, 210, 345/214

See application file for complete search history.

(56) References Cited

U.S. PATENT DOCUMENTS

| | | | | |
|---|---|---|---|---|
| 2004/0036009 | A1* | 2/2004 | Takayanagi et al. | 250/208.1 |
| 2004/0051821 | A1* | 3/2004 | Cheng et al. | 349/43 |
| 2004/0090434 | A1* | 5/2004 | Miyazawa | 345/204 |
| 2006/0007192 | A1* | 1/2006 | De Smet et al. | 345/204 |

* cited by examiner

*Primary Examiner*—Richard Hjerpe
*Assistant Examiner*—Mansour M Said
(74) *Attorney, Agent, or Firm*—Liu & Liu

(57) ABSTRACT

The LCD device includes a pixel circuit and a driving circuit. The pixel circuit comprises thin film transistors serving for driving pixels of the LCD The driving circuit is coupled to the pixel circuit, generating a driving signal for driving the transistors. The gate terminal driving signal of the pixel transistors has a high state and a low state, and the threshold voltage of the transistor is set at a level at zero volt, or depending on whether the transistor is n-type or p-type, between zero volt and the low or high states of the gate terminal driving signal, respectively.

13 Claims, 4 Drawing Sheets

LIQUID CRYSTAL DISPLAY

CROSS-REFERENCE TO RELATED APPLICATION

This application claims the priority benefit of Taiwan application serial no. 92120482, filed on Jul. 28, 2003.

BACKGROUND OF THE INVENTION

1. Field of the Invention

The present invention relates to a Liquid Crystal Display (LCD), more particularly to a low temperature poly-silicon (LTPS) LCD.

2. Description of the Related Art

Computer, communication and consumer products have become the main trend of high technology. Portable electronic devices are also the essential products of development. Of course, displays are also included. Today, the displays include: Plasma Display Panel (PDP), Liquid Crystal Display (LCD), Electro-luminescent Display, Light Emitting Diode Display, Vacuum Fluorescent Display, Field Emission Display (FED) and Electro-chromic Display. Compared with these displays, the low temperature poly-silicon LCD, however, has advantages of high resolution, low power consumption, easy manufacturing process, low costs, low operational temperature, etc. It has potential application and can become the main trend for the next generation displays.

Referring to FIG. 1, it is a timing chart of the low temperature polysilicon LCD in the prior art. When the gate terminal driving signals $V_g$ is in low state, the data signal $V_{data}$ cannot be applied thereto. When the gate terminal driving signals $V_g$ is in high state at T1, the data signal $V_{data}$ can be applied thereto. The pixel voltage $V_{pixel}$ arises. When the gate terminal driving signals $V_g$ is down to low state at T2, the data signal $V_{data}$ also be turned off and the pixel voltage $V_{pixel}$ charges the capacitor and keeps thereat for turning on the pixel. When the power is disconnected at T3, the gate terminal driving signals $V_g$ and the data signal $V_{data}$ suddenly drop to 0V. Because the NMOS thin film transistors have been turned off, the charges stored in the capacitor can not be discharged immediately. Therefore, remaining images will exist on the LCD for tens of seconds to several minutes.

Referring to FIG. 2, an I-V curve of the NMOS thin film transistor of the low temperature poly-silicon LCD panel in prior art is shown. The gate terminal driving signals $V_g$ has a high state $V_{gh}$ and a low state $V_{gl}$. Because the threshold voltage of the NMOS thin film transistors and the voltage of the driving circuit are both higher than 0V, the remaining images exist. Therefore, when the gate terminal driving signals $V_g$ is down to 0V, the NMOS thin film transistors are turned off and the pixel voltage $V_{pixel}$ cannot be discharged immediately.

SUMMARY OF THE INVENTION

The present invention is directed to a Liquid Crystal Display (LCD) device in which substantially no remaining image, or in some cases, almost no remaining image will exist therein when the power is disconnected.

The LCD device includes a pixel circuit and a driving circuit. The pixel circuit comprises thin film transistors serving for driving pixels of the LCD. The driving circuit is coupled to the pixel circuit, generating a driving signal for driving the transistors. The gate terminal driving signal of the pixel transistors has a high state and a low state, and the threshold voltage of the transistor is set at a level depending on whether the transistor is n-type or p-type. Preferably, the threshold voltage is equal to or less than 0 volt for the n-type and the threshold voltage is equal to or greater than 0 volt for the p-type.

In one embodiment of the present invention, the pixel transistors comprises NMOS thin film transistors, and the threshold voltage of the NMOS thin film transistors is set at a level lower than or equal to zero volt, and higher than the low state of the gate terminal driving signal. Because the transistors have a threshold voltage no more than 0V, substantially no remaining image will exist in the LCD when the power is disconnected.

In another embodiment of the present invention, the pixel circuit comprises a plurality of PMOS thin film transistors serving for driving pixels of the LCD and the PMOS thin film transistors have a threshold voltage no less than 0V, and lower than the high state of the gate terminal driving signal.

In another embodiment of the invention, the invention provides a method of driving a pixel in a liquid crystal display (LCD) device, comprising: operatively coupling a thin film transistor of n-type or p-type to the pixel; and generating a gate terminal driving signal having a low and high state to drive the thin film transistor. Wherein the transistor has a threshold voltage that is set at a level at zero volt, or depending on the whether the transistor is n-type or p-type, between zero volt and the low or high state of the gate terminal driving signal, respectively.

Various embodiments accompanied with figures are described in detail below.

DESCRIPTION OF SOME EMBODIMENTS

Figure 7:
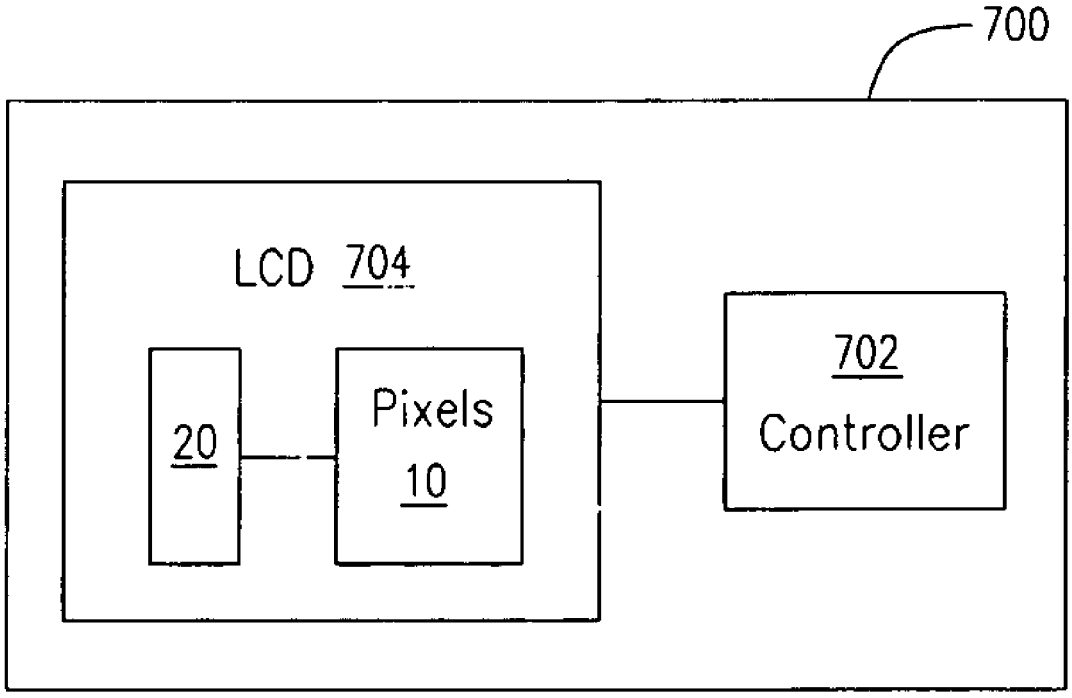
FIG. 7 is a schematic drawing of an electronic device in accordance with one embodiment of the present invention.

First referring to FIG. 7, FIG. 7 is a schematic diagram of an electronic device 700 in accordance with one embodiment of the present invention. The electronic device 700 can include a controller 702 and an LCD 704 of the invention. The LCD 702 includes a pixel circuit 10 and a driving circuit 20. The electronic device 700 can be for example, a portable computer, a mobile telephone, a portable electronic game. The electronic device includes a LCD panel in accordance with the present invention as disclosed below. The descriptions in detail are as follows.

Figure 1:
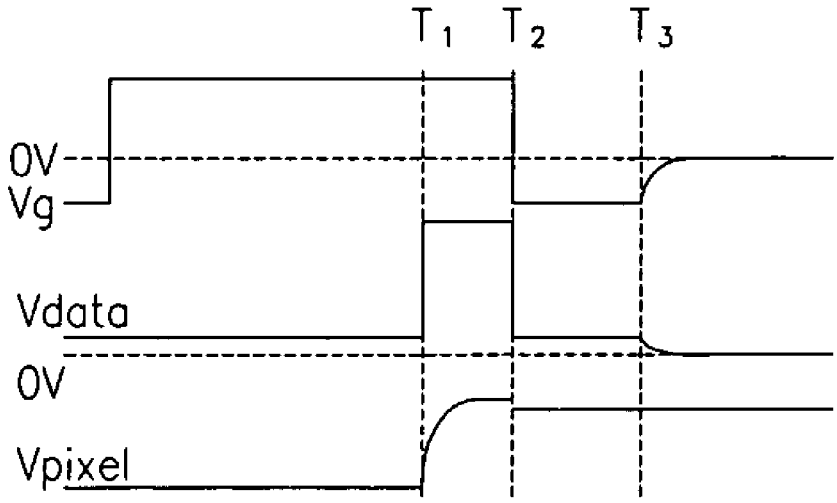
FIG. 1 (PRIOR ART)
FIG. 1 is a timing chart of a conventional low temperature poly-silicon panel.
Figure 2:
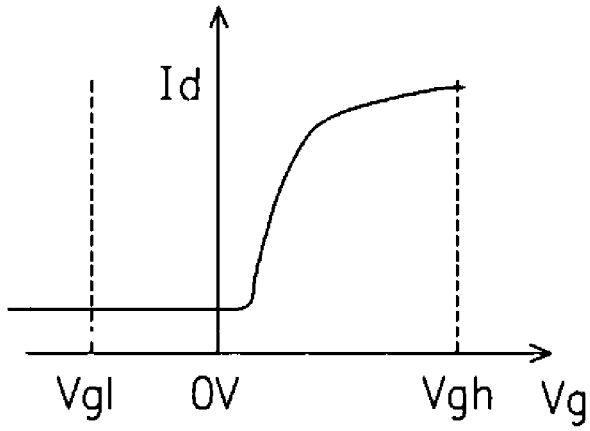
FIG. 2 (PRIOR ART)
FIG. 2 is an I-V curve of the NMOS thin film transistor of the conventional low temperature poly-silicon panel.
Figure 3:
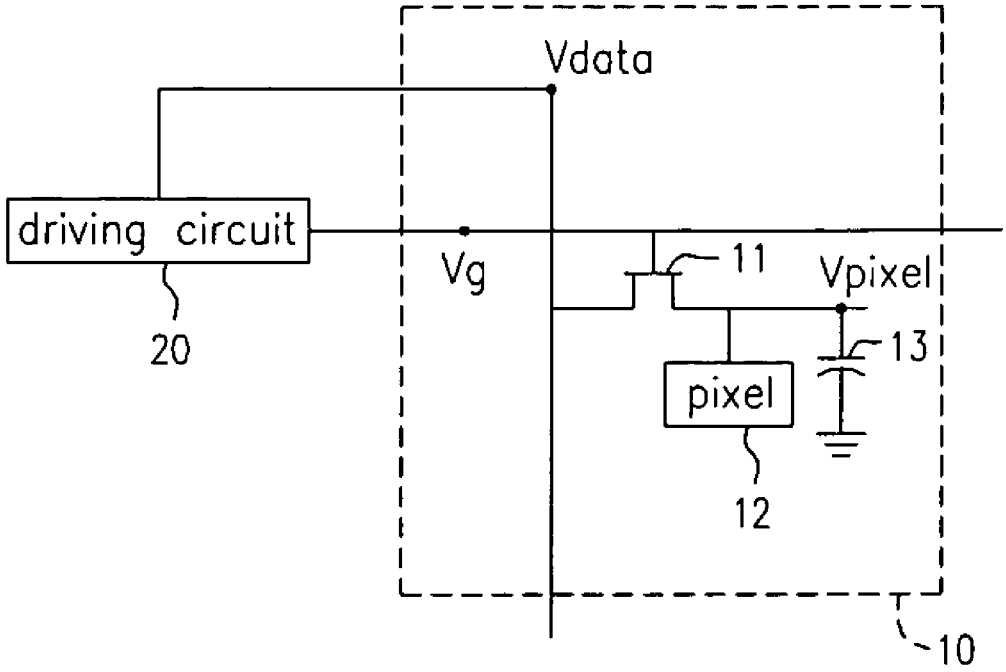
FIG. 3 is a schematic drawing showing a first exemplary low temperature poly-silicon panel of the present invention.

Referring to FIG. 3, a schematic drawing showing a LCD 704 shown in FIG. 7. The LCD panel 704 can be a low temperature polysilicon LCD panel, but is not limited thereto. The pixel circuit 10 is one of pixel circuits in the low temperature poly-silicon LCD. The driving circuit 20 is coupled to the pixel circuit 10, wherein the pixel circuit 10 comprises a NMOS thin film transistor 11, a pixel 12 and a capacitor 13. The driving circuit 20 couples the gate terminal driving signals $V_g$ to the gate terminal of the NMOS thin film transistor 11 and data signal $V_{data}$ is coupled to the drain terminal of the NMOS thin film transistor 11. The pixel 12 and the capacitor 13 are coupled to the source terminal of the NMOS thin film transistor 11 and the pixel voltage $V_{pixel}$ serves to control color change and brightness of the pixel 12.

The driving circuit 20 sends the gate terminal driving signals $V_g$ for driving the NMOS thin film transistor 11. The gate terminal driving signals $V_g$ has a high state and a low state. The high state is higher than zero volt and the low state is lower than zero volt. For example, the high state can be 10V and the low state can be −5V. The threshold voltage of the NMOS thin film transistor 11 is lower than, or equal to, 0V, but higher than the low state (i.e., −5V).

When the gate terminal driving signals $V_g$ is −5V which is lower than the threshold voltage of the NMOS thin film transistor 11, the $V_{data}$ cannot be applied thereto. When the gate terminal driving signals $V_g$ is 10V which is higher than the threshold voltage of the NMOS thin film transistor 11, the $V_{data}$ can be applied thereto and the capacitor 13 is being charged. When the power is disconnected, the gate terminal driving signals $V_g$ suddenly drops to 0V. Because the gate terminal driving signals $V_g$ is still higher than the threshold voltage, the capacitor 13 can be discharged rapidly and substantially no remaining image exists, and in some cases, no remaining image exists.

Figure 4:
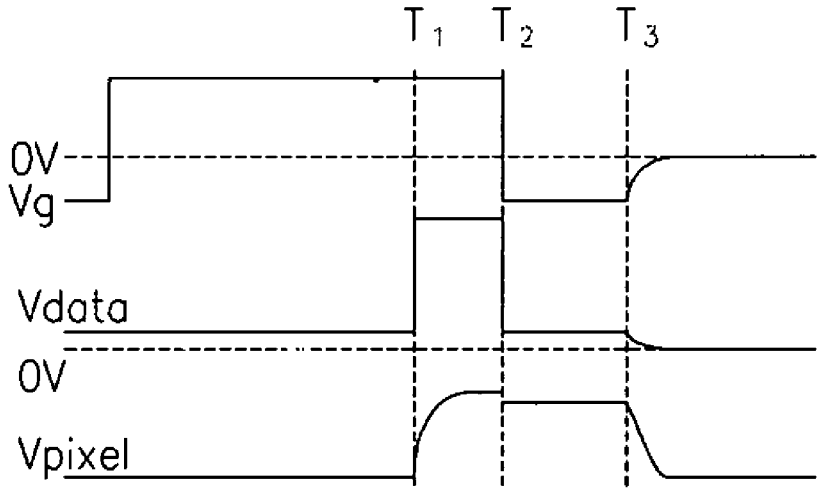
FIG. 4 is a timing chart showing the first exemplary low temperature poly-silicon panel of the present invention.

Referring to FIG. 4, a timing chart showing the first exemplary low temperature poly-silicon LCD of the present invention is shown. When the gate terminal driving signals $V_g$ is in low state, the $V_{data}$ cannot be applied thereto. Therefore, the pixel voltage $V_{pixel}$ keeps at the low state. When the gate terminal driving signals $V_g$ is in high state at T1, the $V_{data}$ can be applied thereto and the pixel voltage $V_{pixel}$ charges the capacitor. The charge step is complete at $T_2$ and the gate terminal driving signals $V_g$ is down to low state. Therefore, the pixel voltage $V_{pixel}$ keeps at the required state. At T3, when the power is disconnected, the pixel voltage $V_{pixel}$ can be discharged and no remaining image exists.

Figure 5:
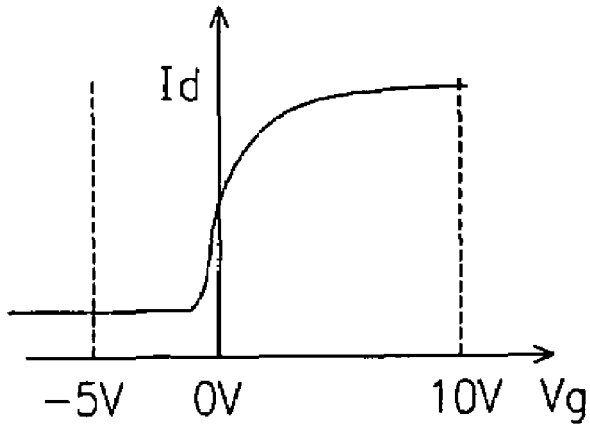
FIG. 5 is an I-V curve of the NMOS thin film transistor of the first exemplary low temperature poly-silicon panel of the present invention.

Referring to FIG. 5, an I-V curve of the NMOS thin film transistor of a first exemplary low temperature poly-silicon LCD of the present invention is shown. In the embodiment, the threshold voltage of the NMOS thin film transistor is no more than 0V. When the gate terminal driving signals $V_g$ is down to 0V, the NMOS thin film transistor will not be turned off and the pixel voltage $V_{pixel}$ can be discharged.

Figure 6:
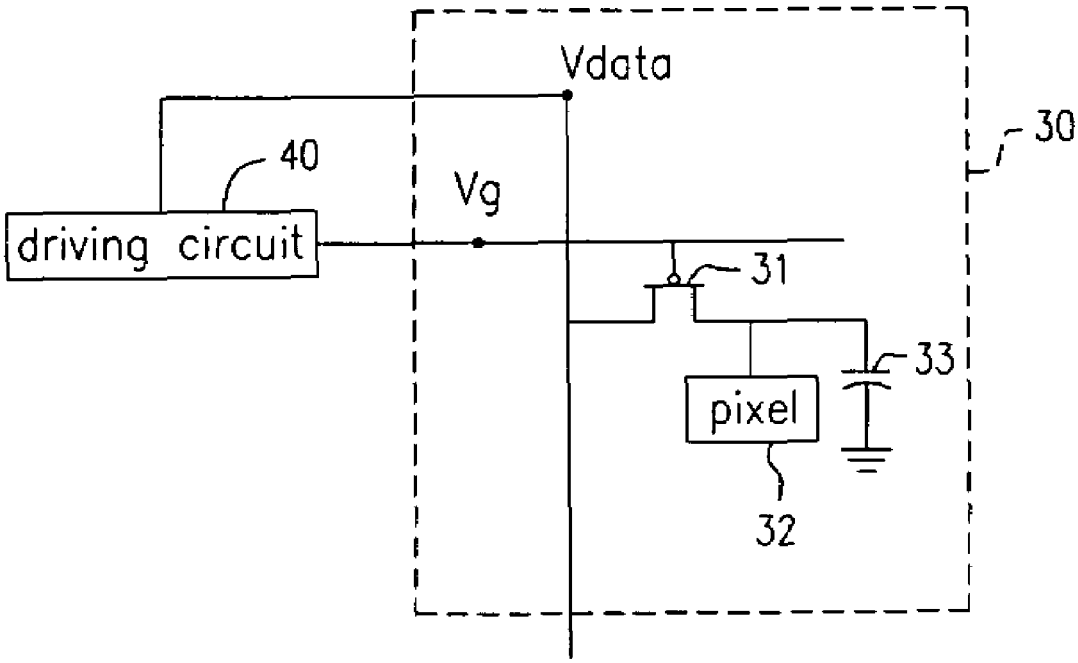
FIG. 6 is a schematic drawing showing a second exemplary low temperature poly-silicon panel of the present invention.

Referring to FIG. 6, a schematic drawing showing a second exemplary low temperature poly-silicon LCD of the present invention is shown. The pixel circuit 30 is one of pixel circuits in the low temperature poly-silicon LCD. The driving circuit 40 is coupled to the pixel circuit 30, wherein the pixel circuit 30 comprises a PMOS thin film transistor 31, a pixel 32 and a capacitor 33. The driving circuit 40 couples the gate terminal driving signals $V_g$ to the gate terminal of the PMOS thin film transistor 31 and data signal $V_{data}$ is coupled to the drain terminal of the PMOS thin film transistor 31. The pixel 32 and the capacitor 33 are coupled to the source terminal of the PMOS thin film transistor 31 and the pixel voltage $V_{pixel}$ serves to control color change and brightness of the pixel 32.

The driving circuit 40 sends the gate terminal driving signals $V_g$ for driving the PMOS thin film transistor 31. The gate terminal driving signals $V_g$ has a high state $V_{gh}$ and a low state $V_{gl}$. The threshold voltage of the PMOS thin film transistor 31 is higher than, or equal to, 0V, but smaller than $V_{gh}$.

Because the operation of the PMOS thin film transistor is opposite to that of the NMOS thin film transistor, the operation of the gate terminal driving signals $V_g$ is opposite to that of gate terminal driving signals $V_g$ in the first embodiment. The descriptions similar thereto are not repeated herein, and it should be understood by the ordinary skilled artisans.

Although the present invention has been described in terms of exemplary embodiments, it is not limited thereto. Rather, the appended claims should be constructed broadly to include other variants and embodiments of the invention which may be made by those skilled in the field of this art without departing from the scope and range of equivalents of the invention.

What is claimed is:

1. A circuit for driving a pixel in a liquid crystal display (LCD) device, comprising:

a pixel circuit, having a thin film transistor of n-type or p-type, operatively coupled to the pixel; and a driving circuit, operatively coupled to the pixel circuit, generating a gate terminal driving signal having a low and high state for driving the thin film transistor, wherein if the transistor is n-type, its threshold voltage is set at a level between the low state of the gate terminal driving signal and no more than zero volt, and wherein if the transistor is p-type, its threshold voltage is set at a level between the high state of the gate terminal driving signal and no less than zero volt.

2. The circuit of claim 1, wherein the transistor is an NMOS transistor.

3. The circuit of claim 1, wherein the transistor is a PMOS transistor.

4. The circuit of claim 1, wherein the pixel is of low temperature poly-silicon type.

5. A liquid crystal display device comprising:

at least one liquid crystal display pixel; a circuit as in claim 1.

6. The liquid crystal display device as in claim 5, wherein the liquid crystal display pixel is of low temperature poly-silicon typ.

7. An electronic device, comprising:

a liquid crystal display device as in claim 5, a controller providing image data the liquid crystal display device.

8. The electronic device as in claim 7, wherein the liquid crystal display device is of low temperature poly-silicon type.

9. The method as in claim 8, wherein the pixel is of low-temperature poly-silicon type.

10. A method of driving a pixel in a liquid crystal display (LCD) device, comprising:

operatively coupling a thin film transistor of n-type or p-type to the pixel; and generating a gate terminal driving signal hating a low and high state to drive the thin film transistor, wherein if the transistor is n-type, its threshold voltage is set at a level between the low state of the gate terminal driving signal and no more than zero volt, and wherein if the transistor is p-type, its threshold voltage is set at a level between the high state of the gate terminal driving signal and no less than zero volt.

11. A circuit for driving a pixel in a liquid crystal display (LCD) device, comprising:

a pixel circuit, having a thin film transistor of n-type or p-type, operatively coupled to the pixel; and a driving circuit, operatively coupled to the pixel circuit, generating a gate terminal driving signal having a low and high stats for driving the thin film transistor, wherein if the transistor is n-type, the transistor has a threshold voltage that is set between no more than zero volt and the low state of the gate terminal driving signal, or if the transistor is p-type, the transistor has a threshold voltage that is set at a level of between no less than zero volt and the high state of the gate terminal driving signal.

12. The circuit of claim 11, wherein the transistor is an NMOS transistor.

13. The circuit of claim 11, wherein the transistor is a PMOS transistor.

* * * * *